United States Patent [19]

Bommaraju et al.

[11] 4,295,951

[45] Oct. 20, 1981

[54] FILM-COATED CATHODES FOR HALATE CELLS

[75] Inventors: Tilak V. Bommaraju, Grand Island; Theodore H. Dexter, Lewiston; Charles G. Rader, Grand Island, all of N.Y.

[73] Assignee: Hooker Chemicals & Plastics Corp., Niagara Falls, N.Y.

[21] Appl. No.: 149,814

[22] Filed: May 14, 1980

[51] Int. Cl.[3] ..... C25B 9/00; C25B 11/03; C25B 11/10

[52] U.S. Cl. ..... 204/242; 204/284; 204/290 R; 204/290 F; 204/95

[58] Field of Search ..... 204/290 R, 290 F, 242, 204/95, 98, 284

[56] References Cited

U.S. PATENT DOCUMENTS

| | | | |
|---|---|---|---|
| Re. 29,419 | 9/1977 | De Craene | 204/290 F |
| 4,086,155 | 4/1978 | Jonville | 204/290 R X |
| 4,101,395 | 7/1978 | Montani et al. | 204/290 R X |
| 4,118,294 | 10/1978 | Pellegri | 204/290 F X |
| 4,151,052 | 4/1979 | Goto et al. | 204/95 |
| 4,197,178 | 4/1980 | Pellegri et al. | 204/290 R X |
| 4,217,195 | 8/1980 | Uzgiris et al. | 204/290 R X |
| 4,235,695 | 11/1980 | De Nora et al. | 204/290 F X |

FOREIGN PATENT DOCUMENTS

| | | | |
|---|---|---|---|
| 1490168 | 6/1967 | France | 204/290 R |
| 445947 | 12/1974 | U.S.S.R. | 204/290 R |

*Primary Examiner*—Donald R. Valentine
*Attorney, Agent, or Firm*—William G. Gosz

[57] ABSTRACT

A film-coated cathode is provided for the electrolysis of alkali metal halide solutions in the substantial absence of chromium ions. The cathode comprises a conductive substrate, such as titanium, steel, iron, or alloys thereof, coated with an adherent, porous film of a substantially nonconductive material having an average coating thickness of less than about $10^3$ microns. The nonconductive, film-forming material is further characterized as being chemically inert in the halate solution.

11 Claims, No Drawings

FILM-COATED CATHODES FOR HALATE CELLS

BACKGROUND OF THE INVENTION

The present invention relates to a film-coated cathode for alkali metal halate electrolysis, and to methods for preparing such cathodes. The cathodes of the present invention permit electrolytic operation with enhanced current efficiency without requiring the addition of chromate or dichromate ions to the halate solution.

Sodium chlorate is currently manufactured by the electrolysis of sodium chloride brine in electrolytic cells which provide for the mixing of the various electrolysis products: hydrogen, sodium hydroxide and chlorine. The electrolytic chlorate cells may be similar in design and configuration to chlor-alkali cells except that an intermediate barrier or cell separator is omitted to provide for product mixing. During the electrolysis of the chlorate solution, hydrogen gas is formed at the cathode along with sodium hydroxide while chlorine is formed at the anode. Hypochlorous acid and sodium hypochlorite are formed chemically in solution according to the following equilibrium reaction:

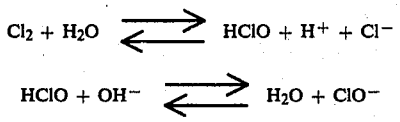

$$Cl_2 + H_2O \rightleftharpoons HClO + H^+ + Cl^-$$

$$HClO + OH^- \rightleftharpoons H_2O + ClO^-$$

Hypochlorous acid and sodium hypochlorite combine, under suitable conditions, to form sodium chlorate. The overall reaction can thus be described as follows:

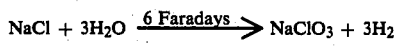

$$NaCl + 3H_2O \xrightarrow{\text{6 Faradays}} NaClO_3 + 3H_2$$

Although the principal reaction at the cathode is the formation of hydrogen gas, there are other secondary reactions at the cathode which affect the efficiency of sodium chlorate production. Two such reactions are the cathodic reductions of sodium hypochlorite and sodium chlorate to sodium chloride and water as follows:

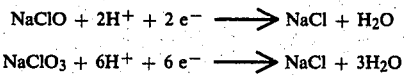

$$NaClO + 2H^+ + 2e^- \longrightarrow NaCl + H_2O$$

$$NaClO_3 + 6H^+ + 6e^- \longrightarrow NaCl + 3H_2O$$

The reductions of hypochlorite and/or chlorate ions in the cell, as described by the foregoing reactions, are undesirable, inasmuch as said reductions can effectively result in a loss in current efficiency, as measured by the change in concentration of sodium chlorate in the solution, of as much as 80% or more.

It has been known for many years that the addition of small amounts of chromates, such as sodium chromate or sodium dichromate, to chlorate cell liquor, typically in amounts of 2 to 5 g./l. of solution, effectively prevents the reduction of hypochlorite and/or chlorate ions at the cathode, resulting in enhanced cell current efficiencies. It has been hypothesized that the effectiveness of chromates in chlorate production is due, at least in part, to the formation of a $Cr(OH)_3$ film on the surface of the cathode during operation of the chlorate cell in the presence of chromate, which prevents the cathodic reduction of hypochlorite and chlorate ions.

Unfortunately, however, the continued use of chromate additives in chlorate manufacture is subject to several limitations which have stimulated a search for more desirable substitutes. For example, world-wide supplies of chromium or are subject to disruption which could lead to limited supplies and/or higher costs for chromate additives. In addition, there are significant environmental restrictions associated with the use of chromates. Accordingly, there is a preceived and growing need for eliminating, or at least reducing, the use of chromate additives in chlorate cells.

It is thus a primary object of the present invention to provide a viable alternative to the use of chromates in chlorate cells, without sacrificing cell performance and efficiency. This object is achieved by providing a cathode having a protective porous film on the surface thereof.

In the past, it has been known to fabricate an electrode from components comprising a polymeric material, or to include a polymer or resin within the structure of the electrode. U.S. Pat. No. 4,118,294 to Pellegri, issued Oct. 3, 1978, discloses such a bipolar electrode for chlor-alkali electrolysis. The bipolar electrode comprises a valve metal anode having an anodically active surface bonded to a cathode formed from a powdered electrically conductive material embedded in electrically conducted relationship in a cured thermosetting resin, the surface of said cathode comprising a powdered catalyst material. Such bipolar electrodes are assembled by molding the cathode components to the valve metal anode structure and spraying the powdered catalytic material onto the cathode surface. The electrode of Pellegri functions to reduce the diffusion of atomic hydrogen into the electrode, but there is not recognition in the reference that such an electrode could serve to eliminate the use of chromate additives in chlorate cells. A similar disclosure is also found in U.S. Pat. No. Re. 29,419 to DeCraene, reissued Sept. 27, 1977, which describes an anode comprising a polymeric matrix containing catalyst particles bonded to a titanium substrate.

U.S. Pat. No. 4,101,395 to Motani et al., issued July 18, 1978, describes a cathode for chlor-alkali electrolysis having an ion exchange membrane laminated on its surface, the ionic exchange material comprising a polymer containing a cationic exchange group.

Although various attempts have been made to reduce or eliminate the use of chromates in sodium chlorate manufacture, including the addition of precipitants to the cell liquor or the use of ion exchange techniques, such attempts have heretofore not proven satisfactory from an economic standpoint.

SUMMARY OF THE INVENTION

The present invention relates to a cathode for chlorate electrolysis having a protective film of a chemically resistant, substantially nonconductive material on the surface thereof. When applied to a suitable conductive substrate material, the film has an average thickness of from about $10^{-4}$ microns to about $10^3$ microns, and has sufficient porosity to permit the transport of hydrogen molecules leaving the cathode, typically in the range of from about 1% to about 85% depending on the thickness of the coating. Suitable film-forming materials are preferably selected from the group consisting of halogenated polymers, such as Teflon, and various metallic and nonmetallic oxides, such as $Cr_2O_3$. The film-forming material can be advantageously applied to the substrate by plasma or thermal spraying, chemical vapor deposition, emulsion techniques, or other suitable techniques which will form a thin, porous surface on the substrate material.

DETAILED DESCRIPTION OF THE INVENTION

The chlorate cell cathodes of the present invention comprise an electrically conductive substrate having a porous film on the surface portion thereof. Materials which are suitable for fabricating the conductive substrate as well known in the art, and, in general, may be selected from any suitable conductive material having the requisite mechanical properties and chemical resistance to the chlorate solution, which generally contains at least about 50% sodium chlorate, with lesser amounts of sodium chloride and sodium hypochlorite, and has a pH of from about 5 to about 7. Suitable conductive materials include ferrous metals or ferrous metal alloys, such as iron or steel, copper, Monel, a copper/nickel alloy manufactured by the International Nickel Co., Inc., and titanium or titanium alloys. Because of their mechanical properties, ease of fabrication, and relatively low cost, iron and/or steel have been traditionally used in chlorate cells. Titanium or titanium alloys are being increasingly used, however, due to their excellent resistance to the corrosive cell environment. U.S. Pat. No. 4,075,070 to DuBois et al., issued Feb. 21, 1978, and which is incorporated herein by reference, discloses a particularly advantageous substrate material comprising a titanium/palladium alloy containing approximately 0.2% palladium by weight.

Once a suitable substrate material is selected, the protective film can then be applied to the substrate using a variety of techniques. Generally, the thickness of the film is dependent on the type of coating material employed, the method of application of the coating material, the porosity of the coating material, and the impressed cathode voltage. For those coating materials, application techniques and operating conditions which are relatively inexpensive and readily available, and are more particularly described herein, average coating thicknesses of from about $10^{-4}$ microns to about $10^3$ microns are suitable. Coating thicknesses of of more than about $10^3$ microns do not provide any particular advantage and, in fact, if a highly nonconductive material is used for the coating material, thicknesses of this magnitude or greater could conceivably prevent the flow of electrical current through the cathode. Thicknesses of less than about $10^{-4}$ microns, while theoretically useful, would, in practice, be difficult to apply to the substrate, resulting in poor adherence and possible failure of the coating.

The coating materials should be chemically resistant to the chlorate solution, and should also be electrically nonconductive, or at least relatively inefficient electrical conductors in comparision to the electrical conductivity of the substrate material. (hereinafter "substantially nonconductive"). In addition, the cathode coating material should also be chemically resistant or inert to the chlorate solution, remaining stable in the solution during conditions of prolonged operation in the presence of concentrations of hypochlorite ions, chlorate ions, chloride ions, and hydroxyl ions, and during conditions of shut-down i.e. open circuit. Coating materials which satisfy these criteria and which have been found particularly suitable for use in the present invention include various halogenated polymers, copolymers and resins, both of the thermosetting and thermoplastic variety, and particularly chlorinated and fluorinated polymers and copolymers, such as polyvinyl chloride, Teflon, a tetrafluoroethylene fluorcarbon polymer manufactured by the E. I. DuPont de Nemours Company, Kel-F, a proprietary chlorotrifluoroethylene polymer manufactured by the Minnesota Mining & Manufacturing Company, and Kalgard, a proprietary tetrafluoroethylene fluorcarbon polymer manufactured by Heany Industries. The polymeric material may also be a thermoplastic polymer, such as polysulfone, or an elastomeric material, such as neoprene rubber or a silicone material. Also suitable as film-forming materials are various metallic and nonmetallic oxides such as zirconium dioxide, titanium dioxide, tantalum oxide, chromic oxide ($Cr_2O_3$), vanadium trioxide, iron oxide, cobalt oxide, aluminum oxide, hafnium dioxide, niobium pentoxide, and silicon dioxide.

The film-forming material can be applied to the substrate by any suitable coating procedure which will produce a thin, adherent film on the substrate having the required porosity. Suitable coating techiques include plasma spraying, thermal spraying, chemical deposition, electrolytic deposition, chemical vapor deposition, vacuum sputtering, and emulsion techniques. The film can also be applied in situ during the electrolysis of an alkali metal chlorate by the addition of a small amount of the appropriate anion or cation into the electrolyte, or by first preforming the film and laminating it to the substrate by, for example, heat sealing. The preferred method for applying the film-forming material to the cathode surface is by plasma spraying using well known procedures.

Prior to coating, the substrate material is preferably cleaned to insure good adhesion of the coating material. Techniques for such preparatory cleaning are conventional and easily adaptable to the present invention. For example, vapor degreasing or sand- or grit-blasting may be utilized, or the substrate may be etched in an acidic solution or cathodically cleaned in a caustic or acidic solution. The substrate material may then be coated directly, or, if desired, an intermediate protective layer to prevent hydrogen permeation and/or an outer layer of an electro-catalytic material to achieve low over voltage may be interposed between the substrate and the film-forming material.

The procedure used for applying the film-forming material to the substrate should produce a film which is both adherent to the substrate and is highly porous. The pores formed in the coating should be large enough to permit the flow of hydrogen molecules from the cathode to the electrolyte, but small engouh to retard the passage of hypochlorite and/or chlorate ions to the conductive substrate. Average pore sizes in the range of from about 0.1 microns to about 30 microns, and an average porosity of from about 1% to about 85%, depending on coating thickness, are satisfactory for this purpose. For extremely thin coatings, if the average porosity is less than about 1%, hypochlorite ions would be reduced to chloride ions in the solution. Average porosities of more than about 85% for relatively thick coatings would prevent the passage of electrical current through the cathode.

When the film-coated cathodes of the present invention are employed to produce alkali metal halates in an electrolytic cell, the cell can operate at high current effficiencies even without the addition of sodium chromate or sodium dichromate to the electrolyte. Accordingly, the operator of such a cell can effectively reduce, or eliminate entirely, the use of chromate additives in chlorate manufacture without adversely affecting the energy consumption or operating efficiency of the cell.

The following examples further illustrate the various aspects of the invention, but are not intended to limit it. Various modifications can be made in the invention without departing from the spirit and scope thereof. When not otherwise specified in the specification and claims, temperatures are given in degrees centigrade and all parts and percentages are by weight.

EXAMPLE 1

An A-36 steel cathode was degreased and sandblasted prior to use as a cathode for the electrolysis of sodium chlorate. Prior to electrolysis, the chlorate solution contained 98.5 g./l. of $NaClO_3$, but did not contain chromate ions. The solution was electrolyzed for 4 hours at a current density of 1.67 asi. The temperature of the solution was recorded as 70° C., and a pH of 6.5 was also measured. Following electrolysis, the solution contained 90.5 g./l. of $NaClO_3$ and 11.47 g./l. of NaCl, for a current efficiency of about 80% for the reduction of chlorate to chloride ions, based on the amount of NaCl present in the solution.

EXAMPLE 2

Following the procedure of Example 1, an A-36 steel cathode was degreased and sandblasted prior to use as a cathode for the electrolysis of sodium chlorate. The electrolyte solution, prior to electrolysis, contained 106.3 g./l. of $NaClO_3$ and 2.5 g./l. of $Na_2Cr_2O_7$. Following electrolysis for 4 hours under the conditions of Example 1, the solution contained 104.1 g./l. of $NaClO_3$ and less than 0.5 g./l. of NaCl, representing a current efficiency of about 0% for the reduction of chlorate to chloride, based on the amount of NaCl present in the solution.

EXAMPLE 3

Following the procedure of Example 1, an A-36 steel plate was degreased, sandblasted, and plasma sprayed with Kalgard, a proprietary product of Heany Industries, to an average thickness of 10 mils, and subsequently used as a cathode for the electrolysis of a sodium chlorate electrolyte. Prior to electrolysis, the electroltye solution contained 101.4 g./l. of $NaClO_3$, but did not contain chromate ions. Following electrolysis for 4 hours under the conditions of Example 1, the solution contained 100.3 g./l. of $NaClO_3$ and less than 0.5 g./l. of NaCl, for a current efficiency of about 0% for the reduction of chlorate to chloride ions, based on the amount of NaCl present in the solution.

EXAMPLE 4

Following the procedure of Example 1, an A-36 steel plate was degreased, sandblasted, and plasma sprayed with $Cr_2O_3$ to a thickness of 10 mils and used as a cathode in an electrolytic cell for the electrolysis of sodium chlorate. Prior to electrolysis, the electrolyte solution contained 102.0 g./l. of $NaClO_3$ but did not contain chromate ions. Following electrolysis for 4 hours under the conditions of Example 1, the solution contained 100.6 g./l. of $NaClO_3$ and less than 0.5 g./l. of NaCl, for a current efficiency of about 0% for the reduction of chlorate to chloride, based on the amount of NaCl present in the solution.

A comparison of the results of Examples 3 and 4, ilustrating two embodiments of the present invention, with the results of Example 2, illustrating a conventional cathode in a chlorate cell with sodium dichromate added to the electrolyte, show comparable reductions in current efficiency for chlorate and/or hypochlorite reduction when compared to the use of a conventional steel cathode in a chlorate electrolyte which does not include a chromate additive (Example 1), thus demonstrating that the cathodes of the present invention can effectively eliminate the use of chromate additives without sacrificing operating efficiency or performance.

Although the present invention has been described in terms of certain specific embodiments, it is to be understood that modifications and variations may be made without departing from the spirit and scope of the invention, as those of ordinary skill in the art will readily understand. Such modifications and variations are considered to be within the purview and scope of the appended claims.

What is claimed is:

1. A halate cell cathode for the production of alkali metal halates in the absence of chromium ions, said cathode comprising a conductive substrate coated with an adherent, porous flm of a substantially nonconductive, chemically inert material, said film having an average thickness of from about $10^{-4}$ microns to about $10^3$ microns an average porosity of from about 1% to about 85%, and an average pore size of from about 0.1 micron to about 30 microns.

2. The cathode of claim 1 wherein the conductive substrate is a ferrous material.

3. The cathode of claim 1 wherein the conductive substrate is titanium or an alloy thereof.

4. The cathode of claim 1 wherein an intermediate protective layer is provided between the film and the substrate.

5. The cathode of claim 1 wherein a layer of an electro-catalytic material is provided between the film and the substrate.

6. The cathode of claim 1 wherein the film material is a polymeric material.

7. The cathode of claim 6 wherein the polymeric material is a fluorocarbon polymer.

8. The cathode of claim 7 wherein the fluorocarbon polymer is a tetrafluoroethylene fluorocarbon polymer.

9. The cathode of claim 1 wherein the film material is an oxide of an element selected from the group consisting of titanium, iron, silicon, chromium, tantalum, hafnium and niobium.

10. The cathode of claim 9 wherein the metal oxide is chromic oxide.

11. In an electrolytic halate cell comprising a cell container, an anode, a cathode, and an alkali metal halate solution, the improvement comprising eliminating the presence of chromium ions in the solution by utilizing, as said cathode, a film-coated cathode comprising a conductive substrate coated with an adherent, porous film of a substantially nonconductive, chemically inert material, said film having an average thickness of from about $10^{-4}$ microns to about $10^3$ microns, an average porosity of from about 1% to about 85%, and an average pore size of from about 0.1 microns to about 30 microns.

* * * * *